United States Patent [19]

Hambleton et al.

[11] Patent Number: 4,557,398

[45] Date of Patent: Dec. 10, 1985

[54] END CLOSURE STRUCTURE FOR A CONTAINER

[75] Inventors: Thomas P. Hambleton, Pine Bush, N.Y.; Erick Guevara, Huntingdon Valley, Pa.; Peter Rychiger, Steffisburg, Switzerland

[73] Assignee: International Paper Company, New York, N.Y.

[21] Appl. No.: 642,054

[22] Filed: Aug. 17, 1984

[51] Int. Cl.[4] ..... B65D 17/34

[52] U.S. Cl. ..... 220/270; 220/260; 220/359

[58] Field of Search ..... 220/260, 270, 359, 265; 229/43

[56] References Cited

U.S. PATENT DOCUMENTS

| | | |
|---|---|---|
| 717,711 | 1/1903 | Norton . |
| 2,147,004 | 2/1939 | Wark et al. . |
| 2,293,142 | 8/1942 | Johnson . |
| 2,340,473 | 2/1944 | Johnson . |
| 2,379,043 | 6/1945 | Stagmeier . |
| 2,629,534 | 2/1953 | Reynolds . |
| 2,870,935 | 1/1959 | Houghtelling . |
| 2,894,844 | 7/1959 | Shakman . |
| 3,057,537 | 10/1962 | Pollick . |
| 3,135,451 | 6/1964 | Bauder et al. . |
| 3,166,226 | 1/1965 | Mobley . |
| 3,274,964 | 9/1966 | Griese, Jr. . |
| 3,281,024 | 10/1966 | Henchert et al. . |
| 3,292,828 | 12/1966 | Stuart . |
| 3,302,818 | 2/1967 | Balocca et al. . |
| 3,312,368 | 4/1967 | Reynolds et al. . |
| 3,339,788 | 9/1967 | Lipske . |
| 3,355,059 | 11/1967 | Balocca et al. . |
| 3,361,611 | 1/1968 | Stark . |
| 3,380,622 | 4/1968 | Garavaglia et al. . |
| 3,389,827 | 6/1968 | Abere et al. . |
| 3,471,351 | 10/1969 | Fuchs . |
| 3,547,305 | 12/1970 | Khoury . |
| 3,731,835 | 5/1973 | Hawkins et al. . |
| 3,871,550 | 3/1975 | Chiappe . |
| 3,883,034 | 5/1975 | Rausing . |
| 3,900,155 | 8/1975 | Rausing et al. . |
| 3,908,857 | 9/1975 | Chiappe ..... 220/260 |
| 3,942,676 | 3/1976 | Beckers et al. . |
| 3,952,911 | 4/1976 | Bozek et al. . |
| 3,958,717 | 5/1976 | Ellis . |
| 3,977,591 | 8/1976 | Martensson et al. . |
| 3,990,603 | 11/1976 | Brochman . |
| 4,024,980 | 5/1977 | Kneusel et al. . |
| 4,029,033 | 6/1977 | Kerwin et al. . |

(List continued on next page.)

FOREIGN PATENT DOCUMENTS

| | | |
|---|---|---|
| 0003603 | 4/1983 | European Pat. Off. . |
| 2835638A1 | 2/1980 | Fed. Rep. of Germany . |
| 57-202911 | 12/1982 | Japan . |
| 58-99391 | 6/1983 | Japan . |
| 58-216586 | 12/1983 | Japan . |
| 593180 | 11/1977 | Switzerland . |
| 598063 | 4/1978 | Switzerland . |
| 627994 | 2/1982 | Switzerland . |

OTHER PUBLICATIONS

"*Introduction of a New Paperboard Container Filling System for Non-Carbonated Drinks*", Packaging Japan, vol. 4, No. 18, Nov., 1983, pp. 20–21; 35–36.

*Primary Examiner*—George T. Hall
*Attorney, Agent, or Firm*—Richard J. Ancel

[57] ABSTRACT

The present invention is an end closure structure for a container having a flexible central member (6) with an outwardly dished center section and at least one opening structure (18) in the central member (6), a removable thin flexible closure member (12) disposed over the opening structure (18) which is in a first sealing relationship (32) with a portion of the opening structure (18) and a second sealing relationship (34) with the top surface of the central member (6), an upwardly extending flange member (8) circumferentially disposed from the peripheral edge of the central member (6), and a downwardly extending sealing skirt (10) circumferentially disposed from a top edge of the flange member (8).

19 Claims, 7 Drawing Figures

U.S. PATENT DOCUMENTS 4,034,132 7/1977 Manuel .
4,036,397 7/1977 Walraven et al. .
4,054,228 10/1977 Balocca et al. .
4,088,242 5/1978 Schellenberg .
4,108,330 8/1978 Patterson .
4,116,359 9/1978 Josephy .
4,135,637 1/1979 Hannula .
4,163,506 7/1979 Patterson .
4,170,314 10/1979 Weierman et al. .
4,176,760 12/1979 Roth .
4,195,748 4/1980 Del Bon .
4,215,791 8/1980 Brochman .
4,232,797 11/1980 Waterbury .
4,253,584 3/1981 Bloeck et al. ..... 220/359
4,253,585 3/1981 Bloeck et al. .
4,290,536 9/1981 Morel .
4,363,582 12/1982 Bloeck et al. .
4,365,457 12/1982 Schellenberg .
4,372,460 2/1983 Brochman et al. .
4,378,074 3/1983 Brochman .
4,397,401 8/1983 Veno et al. ..... 220/260
4,407,429 10/1983 Hekal ..... 220/359

END CLOSURE STRUCTURE FOR A CONTAINER

TECHNICAL FIELD

The present invention relates to an end closure structure for a container. The present invention, more specifically, relates to an end closure structure for a hot-fill or aseptic container. The present invention, even more specifically, relates to a convolute hot-fill container.

BACKGROUND ART

In packaging non-carbonated juices and other similar products, it is desirable to pack and seal them in their heated and sterile condition in a sterile container. When the non-carbonated juice and head space gases cool to ambient temperature in the sealed container, the juice and gases decrease in volume. This decrease in volume causes a drop in pressure within the container. The container must be either structurally strong enough to withstand this pressure drop without being affected, or must in some way positively respond to the pressure drop or the container walls will collapse in places, which is undesirable.

A form of container that is desirable for use as a hot-fill container is a convolute container. These containers are inexpensive to manufacture compared to metal cans, but their walls would collapse to some degree if subjected to the vacuum pressure created within the container as the hot-fill material and internal gases cool to ambient temperature and the end closure structures of the container are substantially nonflexible.

The prior art discloses structures that positively respond to a reduction in pressure in a container caused by cooling of the contents in the container after sealing. Japanese Publication No. 58-99391; Japanese Publication No. 57-202911; and Japanese Publication No. 58-216586, all disclose apparatus that positively respond to a reduction in volume and a resulting decrease pressure in the container by reducing the cross-sectional area of the container as the hot-fill material and gases within the container cool to ambient temperature. Each reference discloses the use of fold or score lines in the side walls to allow them to uniformly fold inwardly to reduce the cross-sectional area of the container. U.S. Pat. Nos. 2,293,142 and 2,340,473 disclose apparatus with a body that can expand and contract in response to the changes in the volume of the contents of material packed in the container, and pressure within the container. These references also disclose the use of fold or score lines for providing a uniform reduction in cross-sectional area in response to the volume and pressure changes within the container.

In the prior art, end closure structures have also been used to positively respond changes in the volume of the contents of material packed in the container and/or pressure within a container. In U.S. Pat. No. 3,057,537, the lid for a paper cup is adapted to move outwardly in response to hot gases from hot coffee or other hot liquids in a container. However, this lid is not designed to move inwardly from its original static position. In U.S. Pat. No. 3,135,451, the lid of a container is drawn to a concave shape by the vacuum pressure in the container. However, this lid is a heavy gauge lid, not particularly flexible, and does not have a thin closure member covering an opening in the lid. In U.S. Pat. Nos. 2,894,844 and 2,379,043, relatively heavy gauge lids and bottom closures disposed on structurally strong containers are initially concave and caused to be pushed outwardly to a convex shape by gases developed by the contents of the container over time. These end closures structures are of this heavy gauge to withstand the internal pressure of the container.

Besides the top end closure structures being adapted to positively respond to volume and/or pressure changes in the container, the prior art discloses a bottom closure structure for the same purpose. The Article entitled, "*Introduction of a New Paperboard Container Filling System for Non-Carbonated Drinks*", Packaging Japan, Vol. 4, No. 18, November, 1983, discloses a laminate paperboard can with a rigid top closure structure and deformable bottom closure structure. The bottom closure structure is inwardly deformable to response to changes in the internal pressure of the container. However, the can is designed for vacuum packing products. By vacuum packing the contents there is significant stress of the seal associated with the opening in the top end closure structure and closure member covering the opening. Because of this stress, the seal is susceptible to becoming oxygen permeable over time.

The prior art also discloses safety-type openings for a can lid. However, as disclosed in U.S. Pat. Nos. 3,380,622 and 4,253,584, the safety openings have a rolled edge to prevent injury to the user, but they only allow for one seal between the lid and closure member covering the opening.

All of the above cited prior art references have inherent problems that would make them undesirable for use on a convolute hot-fill container. The present invention overcomes these problems, and provides an easy to manufacture, simple, inexpensive end closure structure for hot-fill containers to positively respond to a reduction in the volume in the material and gases in the container, and a resulting decrease in pressure in a hot-filled container.

DISCLOSURE OF THE INVENTION

The present invention is an end closure structure for a hot-fill container. The end closure structure of the present invention has two embodiments. The first embodiment has two configurations. Both configurations of the first embodiment have an opening defined therein and are generally used as a top end closure structure. Although the preferred use of the first and second configurations is as end closure structures for a hot-fill container, they can be used on other types of packaging containers, e.g., aseptic packaging containers or spiral wound containers.

The second embodiment of the end closure structure of the invention has two configurations. Both configurations of the second embodiment of the end closure structure of the invention do not have an opening structure defined therein and both are generally used as bottom end closure structures.

The first and second configurations of the first embodiment, and the first and second configurations of the second embodiment of the end closure structure are adapted to be heat and pressure sealed to the respective ends of a hot-fill container. Hot-fill containers which have the end closure structures of the invention disposed thereon can be of other than a cylindrical shape, and the end closure structure of the invention can be adapted to fit such other container shapes.

The first configuration of the first embodiment and both configurations the second embodiment of the end closure structure of the invention can be disposed at the top and bottom ends of a hot-fill container, respectively, with conventional end closure structures opposingly disposed on the other end. Either the first or second configuration or the first embodiment can be used in combination with either the first or second configuration of the second embodiment on the same hot-fill container.

The first configuration of the first embodiment of the end closure structure of the invention has a flexible central member with an opening structure in it. The center section of the central member is outwardly dished a predetermined amount. This predetermined amount of outward dishing is such that when the hot-fill material is sealed within the container in its heated container and cooled to ambient temperature, the center section of flexible central member will flex or be flexed to dish inwardly causing there to be substantially atmospheric pressure or slight vacuum pressure within the container. Because of the substantially atmospheric pressure or slight vacuum pressure within the container, the sealing relationships associated with the opening in the flexible central member and a thin flexible closure member disposed over the opening are not stressed.

The opening in the opening structure in the flexible central member is a safety opening. The opening structure providing the safety opening has two embodiments. In the first embodiment, the cut raw edge of the opening cut in the flexible central member and a small portion of the flexible central member adjacent thereto are bent up and over onto the top surface of the central member. Once they are bent up and over onto the top surface, the portion adjacent to the cut raw edge is pressed downwardly so that the exposed surface of the bent over portion is flush with the top surface of the flexible central member. When the thin flexible closure member is heat and pressure sealed over the opening, a first sealing relationship is formed between the bent over exposed surface of the opening structure and the closure member, and a second sealing relationship is formed between the top surface of the flexible central member adjacent to and surrounding the opening structure and the closure member. The first and second sealing relationships provide two seals in the area of the opening structure with the first sealing relationship being stronger than the second sealing relationship. This ensures that there is a good moisture and oxygen barrier around the opening area of the top end closure structure.

In the second embodiment of the opening structure, there is no bending of the cut raw edge and the adjacent portion of the central member, as described in the first embodiment. In the second embodiment, the thin flexible closure member is heat and pressure sealed to the top surface of the central member over the opening cut in flexible central member. In the process of heat and pressure sealing the closure member to the central member, the heat and pressure are adjusted to cause the thermoplastic coating on the inside surface of the closure member and the thermoplastic coating on the inside surface of the central member to flow together over the cut raw edge of the opening. When the thin flexible closure member is peeled from the central member, part of the mixture of thermoplastic material covering the cut raw edge remains to provide a safety opening. This provides an opening that will not cut or otherwise injure the user when removing the hot-fill material from the container. Besides forming the safety opening for the opening structure, this mixture of thermoplastic provides the seal that is the first sealing relationship. In this embodiment, the first sealing relationship between the two thermoplastic layers over the cut raw edge is stronger than the second sealing relationship between the closure member and the top surface of the central member.

The second configuration of the first embodiment of the end closure structure of the invention has a substantially planar central member. The central member has an opening structure defined therein. The opening structure in the central member also has two embodiments, which are the same as the two embodiments set forth for use with the first configuration of the first embodiment.

The central members of the first and second configurations of the first embodiment have a flange member circumferentially disposed from their respective peripheral edges that extends in the same direction as the initial outward dishing of the center section of their respective central members. Circumferentially disposed from the top edge of their respective flange members is a sealing skirt that extends in a direction opposite that of the initial outward dishing of the center sections of their respective central members. Prior to heat and pressure sealing either configuration of the first embodiment of the end closure structure to an end of a hot-fill container, the sealing skirt forms an acute angle with the flange member. When the end closure structure of either configuration of the first embodiment is to be heat and pressure sealed to a hot-fill container, the end closure structure is positioned so that flange member lies against the inside surface of the end of the container, and the sealing skirt is disposed over the end of the container and extends angularly downward therefrom. Once the end closure structure is in this position, a heat and pressure sealing apparatus engages the end closure structure and bends the sealing skirt inwardly to lie against the outside surface of the end of the container, thereby, sealing the end of the hot-fill container between the sealing skirt and the flange member.

The first and second configurations of the second embodiment of the end closure structure of the invention have a flexible central member that has a center section that is outwardly dished a predetermined amount. This predetermined amount of outward dishing is such that when the hot-fill material is sealed within the container in its heated condition and cooled to ambient temperature with the center section of the flexible central member flexed to deform inwardly during the cooling process, there is substantially atmospheric pressure or a slight vacuum pressure within the container, which prevents stressing of the sealing relationships associated with the opening in the top end closure structure and the thin flexible closure member covering the opening.

The first configuration of the second embodiment of the end closure structure of the invention has a flange member circumferentially disposed from the peripheral edge of the central member that extends in the same direction as the initial outward dishing of the center section of the central member. When the first configuration of the second embodiment is heat and pressure sealed at the bottom end of the container, the end closure structure is positioned in the container such that the outside surface of the flange member lies against the inside surface of the container. The end of the flange member is spaced away from the bottom edge of the container. After the end closure structure is in this position, the portion of the container below the end of the flange member is bent inwardly over the flange member to contact the inside surface of the flange member. The flange member is then heat and pressure sealed between these portions of the container.

The second configuration of the second embodiment of the end closure structure of the invention has a flange member circumferentially disposed from the peripheral edge of its central member that extends in the same direction as the initial outward dishing of the center section of the central member. Circumferentially disposed from the top edge of the flange member is a sealing skirt that extends in a direction opposite that of the initial outward dishing of the center section of the central member. Prior to heat and pressure sealing the end closure structure to the end of a hot-fill container, the sealing skirt forms an acute angle with the flange member. When the second configuration of the second embodiment of the end closure structure is to be heat and pressure sealed to a hit-fill container, the end closure structure is positioned so the flange member lies against the inside surface of the end of the container, and the sealing skirt is disposed over the end of the container and extends angularly downward therefrom. Once the end closure structure is in this position, a heat and pressure sealing apparatus engages the end closure structure and bends the sealing skirt inwardly to lie against the outside surface of the end of the container, thereby, sealing the end of the hot-fill container between the sealing skirt and the flange member.

An object of the invention is to provide an end closure structure for a hot-fill container which has flexible central member with an outwardly dished center section and an opening structure defined therein with a thin flexible closure member covering the opening in the opening structure, and the outward dishing is of a predetermined amount so that after the hot-fill material is sealed within the container and cools to ambient temperature and the flexible central member is flexed to dish inwardly, there is substantially atmospheric pressure or slight vacuum pressure within the container to prevent stressing of the sealing relationships associated with the thin flexible closure member and the opening structure it is disposed over.

Another object of the invention is to provide an end closure structure for extended shelf-life hot-fill packaging containers which has substantially atmospheric pressure or slight vacuum pressure within the container which prevents stressing of the sealing relationships between a closure member and an opening structure it covers defined in the end closure structure.

A still further object of the invention is to provide a hot-fill container with a top end closure structure with a flexible central member having an opening structure defined therein that is sealed at the top end and a bottom end closure structure with a flexible central member without an opening structure that is sealed at the bottom end which cooperate and flex inwardly to respond to a reduction in volume of the hot-fill material and gases, resulting in a drop in pressure within the container when the hot-fill material and gases cool to ambient temperature, so there is substantially atmospheric pressure or slight vacuum pressure within the container to prevent stressing of the sealing relationships associated with a thin closure member and the opening structure in the top end closure structured it is disposed over.

A still further object of the invention is to provide a hot-fill container with a bottom end closure structure that is sealed to a hot-fill container and has a central member with a center section that is initially outwardly dished a predetermined amount so that after hot-fill material and gases sealed in the container cool to ambient temperature and the bottom end closure structure is dished inwardly to respond to a reduction in volume of the hot-fill material and gases, resulting in a drop in pressure within the container, there is substantially atmospheric pressure or slight vacuum pressure within the container to prevent stressing of the sealing relationships between a thin closure member and the opening structure in a substantially planar top end closure structure that is disposed over.

An even still further object of the invention is to provide an opening structure for a top end closure structure for a hot-fill container that has a safety opening.

Another object of the invention is to provide an end closure structure for use on hot-fill containers or other types of containers, such as aseptic packaging containers.

These and other objects of the invention will be described in detail in the remaining portions of the disclosure.

BEST MODE FOR CARRYING OUT THE INVENTION

Figure 1:
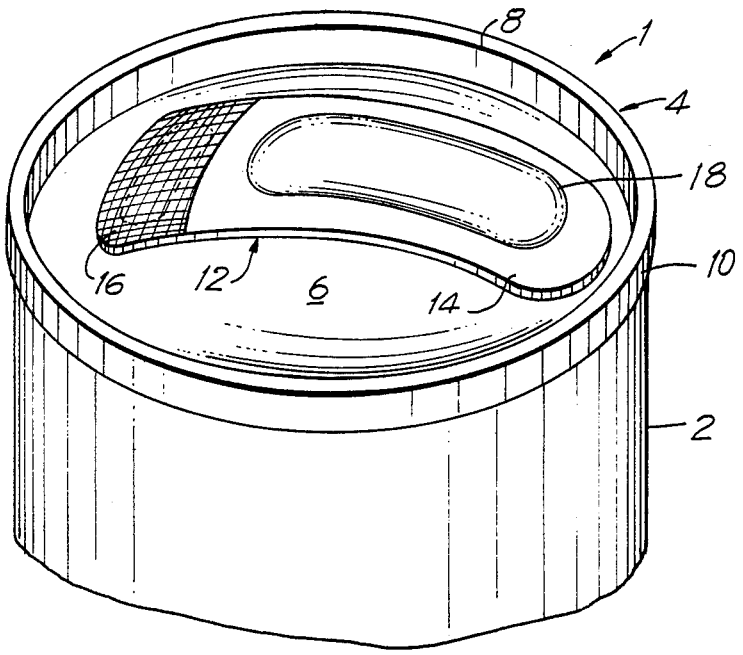
FIG. 1 shows a top perspective view of the first configuration of the first embodiment of the end closure structure of the invention.

In FIG. 1, the first configuration of the first embodiment of the end closure structure of the invention is shown generally at 1. Container 2, which has end closure structure 4 disposed thereon, is a hot-fill container. A preferable form of hot-fill container is a convolute container having a laminate structure suitable for an extended shelf-life packaging container, and constructed with a skived and hemmed side closure seam as disclosed in co-pending patent application Ser. No. 447,104, filed Dec. 6, 1982, of International Paper Company, the assignee of the present application. Although a convolute container of the above indicated construction is preferred, other types of containers can use the end closure structures of the invention, e.g. spiral wound or plastic containers. Even though the hot-fill container shown in the drawings is of a cylindrical shape, it can be of any shape, e.g. rectangular.

Figure 2:
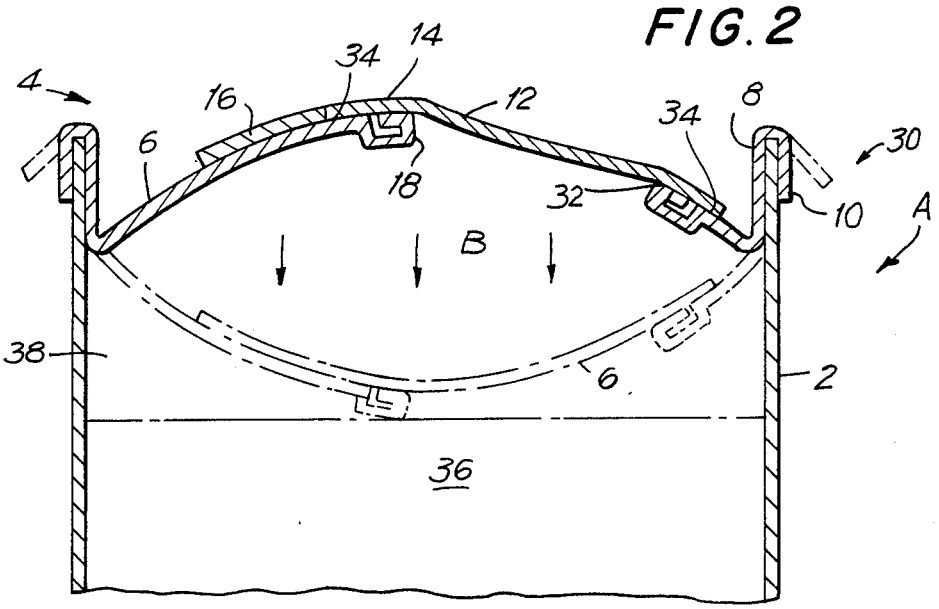
FIG. 2 shows a cross-sectional view of the first configuration of the first embodiment of the end closure structure shown in FIG. 1.
Figure 3:
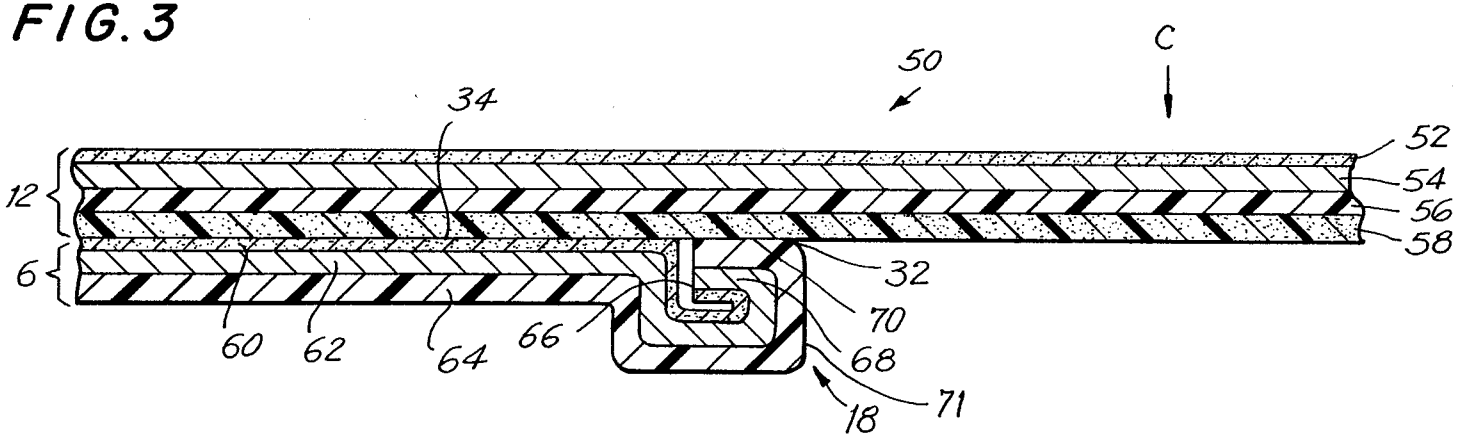
FIG. 3 shows a partial cross-sectional view of the first embodiment of the opening structure and the sealing relationships between the central member and the thin flexible closure member, and the opening structure and the thin flexible closure member.

Referring to FIGS. 1, 2 and 3, the first configuration of the first embodiment of the end closure structure of the invention will be described. End closure structure 4 is disposed on the open top end of the container 2. The bottom closure (not shown) can be a conventional non-flexible closure member known in the art. End closure structure 4 has flexible central member 6 with a center section outwardly dished a predetermined amount. This predetermined amount of outward dishing is such that once hot-fill material 36 is sealed in the container and cools to ambient temperature along with the internal gases, there is substantially atmospheric pressure or slight vacuum pressure within the container after the center section of central member 6 has been inwardly dished, as shown in phantom in FIG. 2.

Opening structure 18 in central member 6 is shown in FIGS. 2 and 3. Opening structure 18 is the first embodiment of the opening structure that provides a safety opening. In FIG. 2, generally at 30, the general relationship among opening structure 18, central member 6 and thin flexible closure member 12 is shown. In FIG. 3, generally at 50, the detailed relationship among opening structure 18, central member 6 and closure member 12, and the sealing relationships therebetween is shown.

Referring to FIG. 3, the formation of opening structure 18, and the sealing relationships between closure member 12 and opening structure 18, and closure member 12 and the top surface of central member 6 will be described.

To form opening structure 18, an opening is first cut in central member 6. Cut raw edge 66 and portion 68 of central member 6 immediately adjacent to the cut raw edge are bent up and over onto the top surface of central member 6. After bending portion 68 up and over onto central member 6, exposed surface 70 of portion 68 is pressed downwardly in direction C, so that exposed surface 70 is flush with the top surface of central member 6. This provides a safety opening with edge 71 which will not cut or injure the user when removing the hot-fill material from the container.

To describe the two sealing relationships, it is first necessary to describe the laminate structures of central member 6 and closure member 12. Closure member 12 has top lacquer coating layer 52 followed by main support foil layer 54. Disposed on the opposite side of main foil support layer 54 is surlyn layer 56 followed by inside surlyn/lacquer coating layer 58. Central member 6 has top lacquer coating layer 60 followed by main foil support layer 62. Disposed on the opposite side of main support foil layer 62 is inside low density polyethylene (LDPE) coating layer 64. When opening structure 18 is formed in the above described method, exposed surface 70 of LDPE is flush with the top surface of central member 6.

When closure member 12 is heat and pressure sealed over the opening in opening structure 18 there are two sealing relationships. The first sealing relationship at 32 is a surlyn/lacquer and LDPE seal between surlyn/lacquer coating 58 and the LDPE of exposed surface 70 of bent over portion 68. The second sealing relationship at 34 is a surlyn/lacquer and lacquer seal between surlyn/-lacquer coating layer 58 and lacquer coating layer 60 disposed at the top surface of central member 6.

Figure 4:
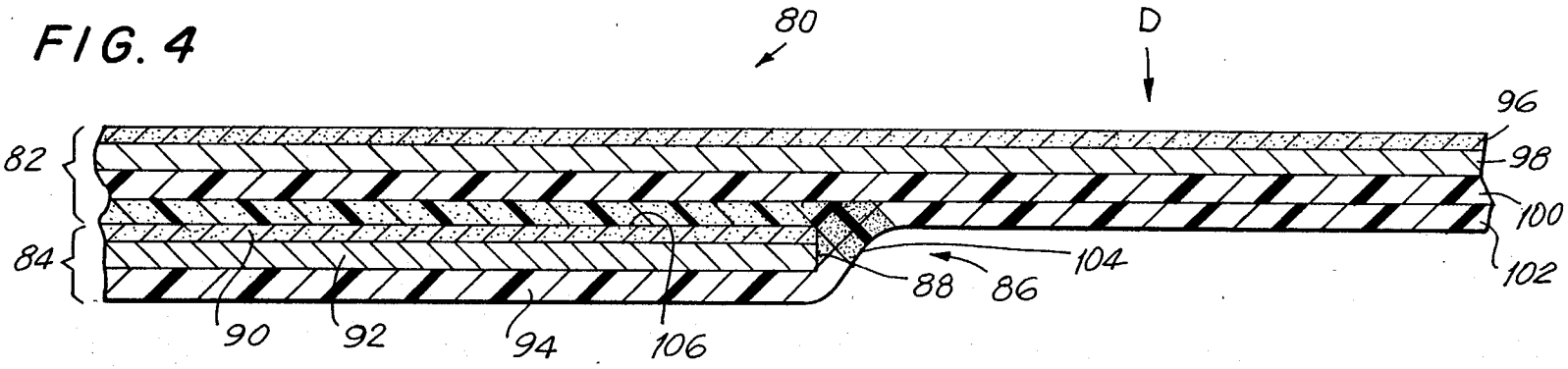
FIG. 4 shows a partial cross-sectional view of the second embodiment of the opening structure and the sealing realtionships between the central member and the thin flexible closure member, and the opening structure and the thin flexible closure member.

Referring to FIG. 4, generally at 80, the second embodiment of the opening structure that provides a safety opening is shown. The laminate structures of thin flexible closure member 82 and flexible central member 84 are substantially the same as discribed for closure member 12 and central member 6 of the first embodiment. Closure member 82 has top lacquer coating layer 96 followed by main support foil layer 98. Disposed on the opposite side of main support foil layer 98 is surlyn layer 100 followed by inside surlyn/lacquer coating layer 102. Central member 84 has top lacquer coating layer 90 followed by main support foil layer 92. Disposed on the opposite side of main support foil layer 92 is inside LDPE coating layer 94.

The formation of the second embodiment of the opening structure will now be described. First an opening is cut in central member 84, the same as for the first embodiment. Opening structure 86 is formed at the time closure member 82 is heat and pressure sealed over the opening cut in central member 84. When closure member 82 is heat and pressure sealed over the opening in central member 84, the heat and pressure is adjusted to cause surlyn/lacquer coating layer 102 of closure member 82 and LDPE coating layer 94 of central member 84 to flow together over cut raw edge 88 of the opening. These two layers flow together to form a seal at 104 which is the first sealing relationship of the second embodiment. The second sealing relationship at 106 is formed between lacquer coating 90 of central member 84 and surlyn/lacquer coating layer 102 of closure member 82. When thin flexible closure member 82 is peeled back to open the hot-fill container, both sealing relationships are broken. However, when the first sealing relationship at 104 is broken, part of the seal material remains disposed over cut raw edge 88 to provide a safety opening to prevent injury to the user when removing the contents of the hot-fill container. It is understood that the second embodiment of the opening structure can be substituted for the first embodiment of the opening structure at any time. Both embodiments of the opening structure prevent any direct contact between the support foil layers and the hot-fill material in the container.

Again referring to FIGS. 1 and 2, disposed circumferentially from the peripheral edge of central member 6 is upwardly extending flange member 8. Flange member 8 is adapted to lie against the interior wall of the top opening of container 2. Circumferentially disposed from the top edge of flange 8 is sealing skirt 10. Prior to sealing end closure structure 4 to container 2, the downwardly extending sealing skirt forms an acute angle with flange 8, as shown in phantom in FIG. 2. When the end closure structure is heat and pressure sealed to the container, the sealing skirt is driven in direction A, so that it lays against the outside surface of the top end of container 2. This squeezes a portion of the top of container 2 between flange member 8 and sealing skirt 10, which seals the end closure structure to container 2. The outside and inside surfaces of container 2, and the surfaces of flange member 8 and sealing skirt 10 which contact them are all coated with thermoplastic material. When heat and pressure sealing is accomplished, there is a thermoplastic to thermoplastic seal formed between the sealing skirt and the outside surface of the container 2 and flange 8 and the inside surface of container 2, thereby, providing a good oxygen and moisture barrier at the top end of the container.

Closure member 12 has two sections. First section 14 is sealed to the bent over portion of opening structure 18 and the top surface of central member 6. Second section 16, adjacent to section 14, is not sealed to the top surface of central member 6. Section 16 is pull tab which is used for opening the container. When it is desired to open the container, pull tab 16 is grasped with the fingers and pulled to peel back the closure member 12, thereby, breaking both seals over opening structure 18.

The process for providing a filled hot-fill container is in accordance with the following procedure for a container having an end closure structure of the first configuration of the first embodiment disposed at the top end of a hot-fill container and a conventional nonflexible end closure at the bottom end of the container. Sterilized hot-fill material 36 is disposed in sterilized container 2 at a temperature between 170° F. and 205° F. to a predetermined level under atmospheric conditions. Once the hot-fill material is so disposed, end closure structure 4 is heat and pressure sealed to the top end of container 2. This is also carried out under atmospheric conditions. When end closure structure 4 is initially sealed on the top end of container 2, central member 6 has its center section outwardly dished, as shown in FIG. 2. It is also to be understood that, if desired, the oxygen can be purged from within the container and replaced with an inert gas, such as nitrogen, or the filling and sealing steps can be carried out in an inert gas field.

As hot-fill material 36 in container 2 cools to ambient temperature, hot-fill material 36 and the gases in head space 38 reduce in volume. This reduction in volume causes a decrease in the pressure within the container. The decrease in pressure in the container causes the center section of flexible central member 6 to be drawn in direction B, as shown in FIG. 2. Since thin closure member 12 is also flexible, it will easily flex with flexible central member 6 to the position shown in phantom in FIG. 2.

Central member 6 having closure member 12 disposed thereon can be flexed to its inwardly dished position by two methods. In the first method, when the hot-fill material has cooled to between 140° F. and 160° F., a mechanical means contacts the center section of central member 6 and pushes it in direction B to its inwardly dished position. The second method is to allow the drop in pressure to draw the center section central member 6 in direction B to its inwardly disposed position. Since there are two sealing relationships associated with the opening structure, there is little possibility of them breaking when the center section of central member 6 and closure member 12 disposed thereon are flexed inwardly.

After hot-fill material 36 has cooled to ambient temperature and the center section of central member 6 is inwardly dished, there is substantially atmospheric pressure or slight vacuum pressure within the container. With substantially atmospheric pressure within the container, the sealing relationship at 32 between the bent over portion of opening structure 18 and closure member 12, and the sealing relationship at 34 between the top surface of central member 6 and closure member 12 are not stressed as would be present if there was a substantial vacuum pressure within the container. Since there is no significant stressing on the sealing relationships, the container has an even longer shelf-life than other hot-fill container constructed similarly, but have their contents vacuum packed.

Figure 5:
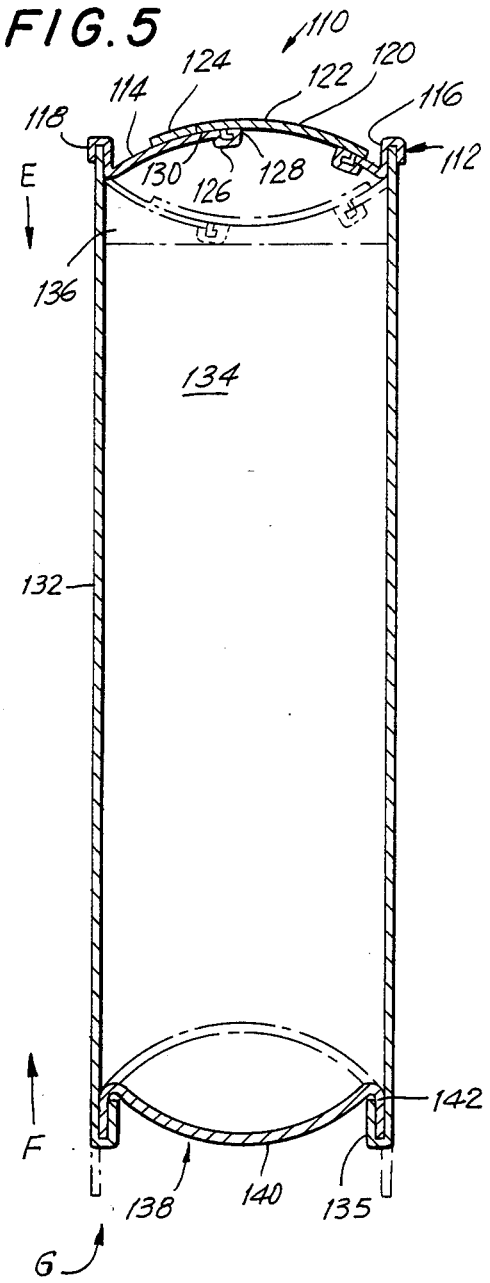
FIG. 5 shows a cross-sectional view of a hot-fill container having a first configuration of the first embodiment of end closure structure of the invention disposed at the top end of the container and a second embodiment of the end closure structure of the invention disposed at the bottom end of the container.

Referring to FIG. 5, generally at 110, a hot-fill container having the first configuration of the first embodiment of the end closure structure of the invention disposed at the top end of the container and the first configuration of the second embodiment of the end closure structure disposed at the bottom end of the container is shown.

Flexible central member 114 of end closure structure 112 has an outwardly dished center section. Central member 114 also has opening structure 128 disposed therein. Disposed over opening structure 128 is thin flexible closure member 120 having two sections. First section 122 in a sealing relationship with a bent over portion of opening structure 128 and the top surface of central member 114. Second section 124, adjacent to section 122, is not in a sealing relationship with the top surface of central member 114 and acts as a pull tab for peeling closure member 120 from the end closure structure.

Circumferentially disposed from the peripheral edge of central member 114 is upwardly extending flange member 116. Circumferentially disposed from the top edge of flange member 116 is sealing skirt 118. When top end closure structure 112 is heat and pressure sealed to the top opening of container 132, flange member 116 and sealing skirt 118 cooperate to seal the top end of the container therebetween to provide an oxygen and moisture barrier at the top end of the container.

Bottom end closure structure 138 is the first configuration of the second embodiment of the end closure structure of the invention. Bottom end closure structure 138 has outwardly dished central member 140. Disposed circumferentially from the peripheral edge of central member 140 is downwardly extending flange member 142. Prior to heat and pressure sealing bottom end closure 138 to the bottom end of containers, it is disposed in the open end of container 132 with the outside surface of flange member 142 lying against the inside surface of the container. Bottom end closure structure 138 is disposed in container 132 such that portion 135 of container 134 extends below the edge of flange member 142, as shown in phantom in FIG. 5. Once bottom end closure structure 138 is in this position, a heat and pressure sealing means bends portion 135 inwardly in direction G over the end of flange member 142 so that portion 135 contacts to the inside surface of flange member 142. Flange member 142 is then heat and pressure sealed between the container wall of container 134 and portion 135.

The outside and inside surfaces of flange member 142, and the inside surface of container 132 that contacts them are coated with thermoplastic material. When the bottom end closure structure is heat and pressure sealed at the bottom end of the container, a thermoplastic to thermoplastic seal is formed between flange member 142 and the surfaces of container 132 that contact the flange member. These seals provide a moisture and oxygen barrier for the bottom end of the container.

The process for providing a filled hot-fill container is in accordance with the following procedure for a container having a top end closure structure of the first configuration of the first embodiment of the invention disposed at the top end of the container and a bottom end closure structure of the first configuration of the second embodiment disposed at the bottom end of the container. After the open ended hot-fill container 132 is formed, bottom end closure structure 138 is heat and pressure sealed to the bottom end of container 132. Initially, the center section of central member 140 of bottom end closure structure 138 is outwardly dished, as shown in FIG. 5. After sealing bottom end closure structure 138 to the bottom opening of container 132, hot-fill material 134 in its heated and sterile condition is disposed in sterile container 132 to a predetermined level. Once this predetermined level is reached, top end closure structure 112 is heat and pressure sealed to the open top end of container 132. As the hot-fill material 134 cools to ambient temperature, hot-fill material 134 and gases in head space 136 reduce in volume, thereby, decreasing the pressure within container 132. As the pressure within container 132 decreases, the center section of flexible central member 114 thin flexible with closure member 120 disposed thereon is drawn in direction E. Once the center section of flexible central member 114 with closure member 120 disposed thereon becomes inwardly dished, as shown in phantom, the further reduction in volume and resulting decrease pressure within the container will cause the center section of central member 140 of bottom end closure structure 138 to inwardly dish in direction F. Since the weight of hot-fill material 134 is directed on bottom end closure structure 138, the center section of central member 114 of top end closure structure 112 will dish inwardly before the center section of central member 140 of bottom end closure member 138. Once the center sections of central members 114 and 140 inwardly dish, respectively, there is substantially atmospheric pressure or slight vacuum pressure within the container. Therefore, the sealing relationships associated with the opening structure in top end closure structure 112 and thin flexible closure member 120 are not stressed.

Figure 6:
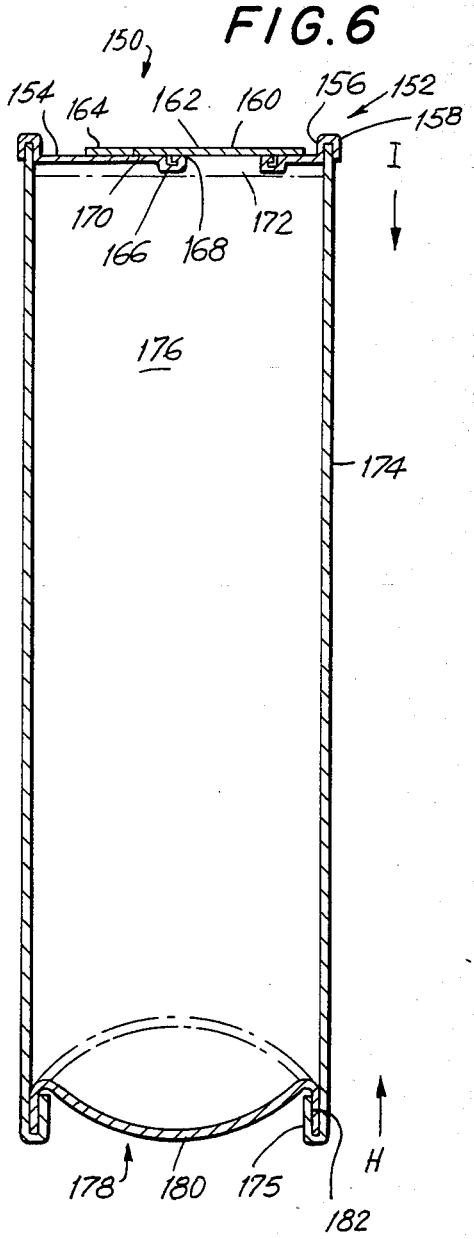
FIG. 6 shows a cross-sectional view of a hot-fill container having the second configuration of the first embodiment of the end closure structure of the invention at the top end of the container and the second embodiment of the end closure structure of the invention disposed at the bottom end of the container.

Referring to FIG. 6, generally at 150, a hot-fill container with the second configuration of the first embodiment of the end closure structure of the invention disposed at the top end of the container and a bottom end closure structure of the first configuration of the second embodiment of the invention disposed at the bottom end of the container is shown.

End closure structure 152, which is the second embodiment of the end closure structure of the invention, has a substantially planar central member 154. Although central member 154 is substantially planar, as shown in FIG. 6, it is not limited to this shape. The central member can have other shapes provided, an opening structure can be defined therein, and a closure member can be sealed over the opening structure such that it is in a first sealing relationship with the opening structure and a second sealing relationship with the top surface of the central member.

Disposed in central member 154 is opening structure 166. The opening structure is formed by the cut raw edge of the cut opening and a small portion adjacent thereto of central member 154 being bent up and over onto the top surface of central 154. The bent over portion is pressed downwardly in direction I such that the exposed surface of the bent over portion is flush with the top surface of central member 154. This provides a safety opening for the opening structure.

Disposed over the opening in opening structure 166 in central member 154 is closure member 160. Closure member 160 has two sections. First section 162 of closure member 160 is in a first sealing relationship with the bent over portion adjacent to the cut raw edge of the opening structure 166 at 168, and in a second sealing relationship with the top surface of planar central member 154 at 170. Section 164 of closure member 160 is not sealed to the top surface of planar central member 154 and is a pull tab. When it is desired to open the container, pull tab 164 is lifted and pulled to cause the thin flexible closure member 160 to peel back to open the container allowing hot-fill material 176 to be removed from the container.

Bottom end closure member 178 is disposed at the bottom end of container 174 and is the first configuration of the second embodiment of the end closure structure of the invention. Bottom closure member 178 is heat and pressure sealed to the open bottom end of container 174. Prior to heat and pressure sealing bottom end closure structure 178 at the bottom end of the container, it is disposed in container 174 such that flange member 182 lies against the inside surface of container 174. Bottom end closure structure is positioned such that portion 175 of container 174 extends below flange member 182. When the bottom end closure is heat and pressure sealed to the container, portion 175 is bent inwardly over the edge of flange member 182 so that portion 175 contacts the inside surface of flange member 182. Once portion 175 is bent inwardly over the edge of flange member 182 end portion 175 contacts the inside surface of flange member 182, heat and pressure sealing means seals the flange 182 between portion 175 and the container wall. This seals bottom end closure 178 to the bottom end of the container.

The inside and outside surfaces of flange member 182, and the inside surfaces of container 174 are coated with thermoplastic material. When bottom end closure structure 178 is heat and pressure sealed at the bottom of the container, there is a thermoplastic to thermoplastic seal formed between the outside and inside surfaces of the flange member and the surfaces of the container wall and portion 175 that contact them. This forms an oxygen and moisture barrier at the bottom of the container.

Bottom end closure structure 178 has central member 180 that with an outwardly dished center section. The center section is outwardly dished a predetermined amount so that when it is flexed inwardly, as shown in phantom in FIG. 6, and hot-fill material 126 and the gases in head space 172 cool to ambient temperature, there is substantially atmospheric pressure or slight vacuum pressure within container 174.

The process for providing a filled hot-fill container is in accordance with the following procedure for a container having the second configuration of the first embodiment of the end closure structure of the invention disposed at the top end of the container and a bottom end closure structure of the first configuration of the second embodiment of the end closure structure of the invention disposed at the bottom end of the container. After container 174 with bottom end closure structure 178 heat and pressure sealed thereto is sterilized, sterilized hot-fill material 176 in its heated condition is disposed in container 174 to a predetermined level. After container 174 is filled to the predetermined level, top end closure structure 152 is heat and pressure sealed to the open top end of container 174.

As the hot-fill material 176 and gases in head space 172 cool to ambient temperature, hot-fill material 176 and the gases in head space 172 reduce in volume, thereby, causing a decrease in pressure within the container. In response to the decrease in pressure in the container, the center section of flexible central member 180 of bottom end closure structure 178 is drawn in direction H. When hot-fill material 176 and the gases in head space 172 cool to ambient temperature with the central member 180 inwardly dished, as shown in phantom in FIG. 6, there is substantially atmospheric pressure or slight vacuum pressure within container 174 to prevent stress on the sealing relationships associated with the opening structure, the top surface of the central member and thin flexible disposed over the opening structure. With the center section of central member 180 of bottom end closure structure 178 in its inwardly dished position, there is very little head space 172 remaining above the surface of hot-fill material 176.

Figure 7:
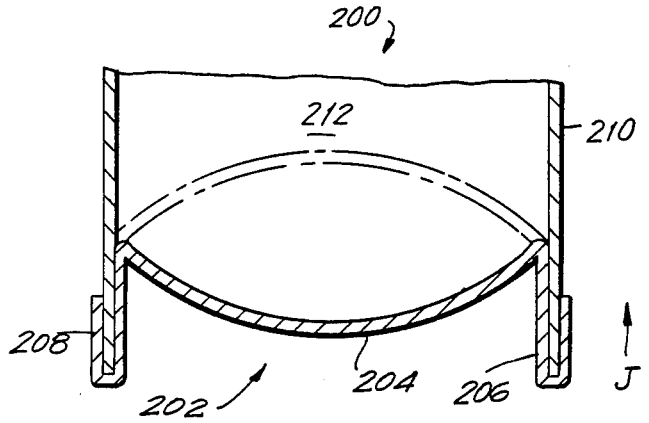
FIG. 7 shows a cross-sectional view of the second configuration of the second embodiment of the end closure structure of the invention.

Referring to FIG. 7, generally at 200, a cross-sectional view of the second configuration of the second embodiment of the end closure structure of the invention is shown disposed at the bottom end of a hot-fill container.

Bottom end closure structure 202 disposed at the bottom end of hot-fill container 210 is the second configuration of the second embodiment of the end closure structure of the invention. Bottom end closure structure 202 has flexible central member 204 with an outwardly dished center section. The center section is outwardly dished the same predetermined amount as the center section of the central member of the first configuration of the second embodiment to allow for substantially atmospheric pressure or slight vacuum pressure within container 210 after the center section is flexed inwardly in direction J, shown in phantom, after the hot-fill material 212 and the internal gases cool to ambient temperature.

The main difference between the first and second configurations of the second embodiment of the end closure structure is the means disposed at the peripheral edge of the central member for sealing the end closure structure to the container. The second configuration of the second embodiment of the end closure structure uses means similar to those described for the first and second configuration of the first embodiment for sealing the end closure structure 202 at the bottom of container 210.

The means for sealing the second configuration to the second embodiment will now be described. Disposed circumferentially from the pheripheral edge of central member 204 is downwardly extending flange member 206. Disposed circumferentially the edge of flange member 206 is upwardly extending sealing skirt 208. Prior to heat and pressure sealing bottom end closure structure 202 to container 210, sealing skirt 208 forms an acute angle with flange member 206. When bottom end closure structure 202 is to be heat and pressure sealed to the bottom of container 210, end closure structure 202 is positioned such that flange member 206 lies against the inside surface of container 210, and the sealing skirt is disposed over the end of container 210 and extends angularly upward therefrom. Once in this position, a heat and pressure sealing means engages end closure structure 202 and drives sealing skirt 208 against the outside surface of container 210, thereby sealing the end of the container between flange member 206 and sealing skirt 208. Since the surfaces of container 210, the surfaces of flange member 206 and the surfaces of sealing skirt 208 are coated with thermoplastic material, a good oxygen and moisture barrier is formed when end closure structure 202 is heat and pressure sealed to the bottom of container 210. It is to be understood that the second configuration of the second embodiment can be substituted for the first configuration of the second embodiment at any time.

The terms and expressions which are employed here are used as terms of description and not of limitation. And there is no intention, in the use of such terms and expressions, of excluding the equivalence of the features shown, and described, it being recognized that various modifications are possible in the scope of the invention as claimed.

We claim:

1. An end closure structure for a container comprising:

a flexible central member having an outwardly dished center section and at least one opening structure disposed in said central member;

a removable flexible closure member disposed over said opening structure and said closure member is in a first sealing relationship with a portion of said opening structure and a second sealing relationship with a top surface of said central member; and means disposed from a peripheral edge of said central member for sealing said end closure structure to an open end of said container.

2. The structure as recited in claim 1, wherein said center section is outwardly dished a predetermined amount such that after hot-fill material is disposed in its heated condition and sealed in said container with said end closure structure, and the hot-fill material is cooled to ambient temperature with said center section of said central member being flexed to dish inwardly during the cooling process there is substantially atmospheric pressure or slight vacuum pressure within said container to prevent stress on said first and second sealing relationships.

3. The structure as recited in claim 1, wherein said opening structure further comprises a cut raw edge of an opening cut in said central member and a small portion of said central member adjacent thereto being bent up and over onto the top surface of said central member and pressed downwardly so that an exposed surface of said bent over portion adjacent to said cut raw edge is substantially flush with the top surface of said central member.

4. The structure as recited in claim 1, wherein said first sealing relationship is stronger than said second sealing relationship.

5. The structure as recited in claim 1, wherein said opening structure further comprises a cut raw edge of an opening cut in said central member covered by thermoplastic material.

6. A container structure comprising:

a tubular member having open top and bottom ends;

a top end closure structure sealed at said top end of said tubular member having a flexible central member with an outwardly dished center section and at least one opening structure disposed in said central member, a removable flexible closure member disposed over said opening structure which is in a first sealing relationship with a portion of said opening structure and a second sealing relationship with a top surface of said central member, and means disposed from a peripheral edge of said central member for sealing said top end closure structure to the top open end of said tubular member; and a bottom end closure structure sealed at said bottom end of said tubular member having a flexible central member with an outwardly dished center section, and means disposed from a peripheral edge of said central member of said bottom end closure structure adapted to be in a sealing relationship with said tubular member at said open bottom end.

7. The structure as recited in claim 6, wherein said center sections of said top and bottom end closure structures are outwardly dished a predetermined amount such that after hot-fill material is disposed in its heated condition and sealed in the container structure with said top and bottom end closure structures, and said hot-fill material is cooled to ambient temperature with said center sections of said central members of said of said top and bottom end closure structures being flexed to dish inwardly during the cooling process there is substantially atmospheric pressure or slight vacuum pressure within the container structure to prevent stress on said first and second sealing relationships.

8. The structure as recited in claim 6, wherein said opening structure further comprises a cut raw edge of an opening cut in said central member and a small portion of said central member adjacent thereto being bent up and over onto the top surface of said central member and pressed downwardly so that an exposed surface of said bent over portion adjacent to said cut raw edge is flush with the top surface of said central member.

9. The structure as recited in claim 6, wherein said first sealing relationship is stronger than said second sealing relationship.

10. The structure as recited in claim 6, wherein said opening structure further comprises a cut raw edge of an opening cut in said central member covered by thermoplastic material.

11. A container structure comprising:

a tubular member having open top and bottom ends;

a top end closure structure sealed at said open top end of said tubular member having a substantially planar central member and at least one opening structure disposed in said central member, a removable flexible closure member disposed over said opening structure which is in a first sealing relationship with a portion of said opening structure and a second sealing relationship with a top surface of said central member, and means disposed from a peripheral edge of central member for sealing said top end closure structure to said top end of said tubular member;

a bottom flexible end closure structure sealed at said bottom end of said tubular member having a flexible central member with an outwardly dished center section, and means disposed from a peripheral edge of said central member of said bottom end closure structure adapted to be in a sealing relationship with said tubular member at said open bottom end.

12. The structure as recited in claim 11, wherein said center section of said central member is outwardly dished a predetermined amount such that after hot-fill material is disposed in its heated condition and sealed in the container structure, and said hot-fill material is cooled to ambient temperature with said center section of central member being flexed to dish inwardly during the cooling process there is substantially atmospheric pressure or slight vacuum pressure within the container structure to prevent stress on said first and second sealing relationships.

13. The structure as recited in claim 11, wherein said opening structure further comprises the cut raw edge of an opening cut in said central member and a small portion of said central member adjacent thereto being bent up and over onto the top surface of said central member and pressed downwardly so that an exposed surface of said bent over portion adjacent to said cut raw edge is flush with the top surface of said central member.

14. The structure as recited in claim 11, wherein said first sealing relationship is stronger than said second sealing relationship.

15. The structure as recited in claim 11, wherein said opening structure further comprises a cut raw edge of an opening cut in said central member covered by thermoplastic material.

16. An end closure structure for a container comprising:

a substantially planar central member having at least one opening structure disposed in said central member;

a removable flexible closure member disposed over said opening structure and said closure member is in a first sealing relationship with a portion of said opening structure and a second sealing relationship with a top surface of said central member; and means disposed from a peripheral edge of said central member for sealing said end closure structure to an open end of said container.

17. A structure as recited in claim 16, wherein said opening structure further comprises a cut raw edge of an opening cut in said central member and a small portion of said central member adjacent thereto being bent up and over onto the top surface of said central member and pressed downwardly so that an exposed surface of said bent over portion adjacent to said cut raw edge is substantially flush with the top surface of said central member.

18. A structure as recited in claim 16, wherein said first sealing relationship is stronger than said second sealing relationship.

19. The structure as recited in claim 16, wherein said opening structure further comprises a cut raw edge of an opening cut in said central member covered by thermoplastic material.

* * * * *